US006715235B2

(12) United States Patent
Salen

(10) Patent No.: US 6,715,235 B2
(45) Date of Patent: Apr. 6, 2004

(54) SEAL FOR A PIVOTING SHIP DOOR

(75) Inventor: Hans Salen, Brännö (SE)

(73) Assignee: Hamworthy KSE AB (SE)

( * ) Notice: Subject to any disclaimer, the term of this patent is extended or adjusted under 35 U.S.C. 154(b) by 146 days.

(21) Appl. No.: 09/864,100

(22) Filed: May 22, 2001

(65) Prior Publication Data

US 2001/0047624 A1 Dec. 6, 2001

(30) Foreign Application Priority Data

May 23, 2000 (SE) ..... 0001904

(51) Int. Cl.[7] ..... E06B 7/28; B63B 19/12; E05B 65/00

(52) U.S. Cl. ..... 49/320; 49/394; 49/475.1; 114/201 R; 114/203; 292/256.5

(58) Field of Search ..... 49/320, 489.1, 49/475.1, 484.1, 495.1, 321, 306, 498.1, 394, 209, 410; 105/377.11, 377.08, 377.07, 377.05, 377.06; 292/144, 41, 33, 256.5; 114/116, 117, 120, 201 R, 202, 203

(56) References Cited

U.S. PATENT DOCUMENTS 2,216,609 A * 10/1940 Bingham ..... 49/394 X
2,433,084 A * 12/1947 Beauchamp ..... 105/377.11
2,507,360 A * 5/1950 Wicks ..... 49/320 X
3,664,270 A * 5/1972 Stark et al. ..... 292/256.5 X
4,420,905 A * 12/1983 Kucharczyk ..... 49/394 X
4,665,653 A * 5/1987 Franz et al. ..... 114/201 R
5,499,475 A * 3/1996 Court et al. ..... 49/495.1
5,941,190 A * 8/1999 Kyle ..... 114/201 R
6,105,529 A * 8/2000 Kyle ..... 114/201 R
6,112,467 A * 9/2000 Bark et al. ..... 49/321

FOREIGN PATENT DOCUMENTS

DE 4141631 * 6/1993 ..... 292/256.5
GB 2220220 * 1/1990 ..... 49/320 X

* cited by examiner

*Primary Examiner*—Hugh B. Thompson
(74) *Attorney, Agent, or Firm*—Orume & Roth

(57) ABSTRACT

A seal for a pivotally mounted door, which is arranged to close off a load area on board a ship and is provided with sealing elements around the periphery of the door and exhibits battening jacks that are caused to move to batten down the door to the deck and bulkhead or parts thereof. A sealing element pivotally supported along the top and/or bottom edge of the door is capable of actuation by a number of the battening jacks causing it to be moved into a sealing (SP) position along the top and/or bottom edge of the door against a contact surface.

20 Claims, 12 Drawing Sheets

SEAL FOR A PIVOTING SHIP DOOR

The present invention relates to an arrangement for a pivotally mounted door, which is so arranged as to close off a load area on board a ship and is provided with sealing elements around the periphery of the door and exhibits battening jacks that are caused to move to batten down the door to the deck and bulkhead.

Previously disclosed are various solutions for seals for ship doors for the purpose of making these as watertight as possible. Sealing elements are often arranged along the whole of the opening in the interior of the ship along which the door is wished to provide a seal, although this means that it is necessary to fit the seals on board the ship, which takes a lot of time and costs a lot of money. If it is wished to replace the seals, for example, this means that it is necessary to enter the ship in order to work, with a resulting significant delay in its availability for use. If elements which incorporate several functions can be prefabricated, it is possible to save up to four times as much time as is required for the subsequent installation of corresponding functions in the ship.

A seal for a door is also previously disclosed through patent application Ser. No. 8201332-7, in conjunction with which the seal is supported by the door itself on the bottom edge of the door and extends along the aforementioned bottom edge of the door. Actuation of the seal takes place entirely separately from actuation of the door with the help of a number of actuating hydraulic cylinders supported by the door. Separate driving means are thus required for the aforementioned seal.

The principal object of the present invention is thus, in the first instance, to solve the aforementioned problems by simple and effectively functioning means and, in conjunction therewith, to cause existing battens to be used to actuate the seal.

The aforementioned object is achieved by means of an arrangement in accordance with the present invention, which is characterized essentially in that a sealing element pivotally supported along the top and/or bottom edge of the door is capable of actuation by a number of the aforementioned battening jacks causing it to be moved into a sealing position along the top and/or bottom edge of the door against a contact surface.

The invention is described below as a number of preferred illustrative embodiments, in conjunction with which reference is made to the accompanying drawings, in which FIG. 1 shows a side view of a door with a sealing arrangement at the top in accordance with the invention;

Figure 15:
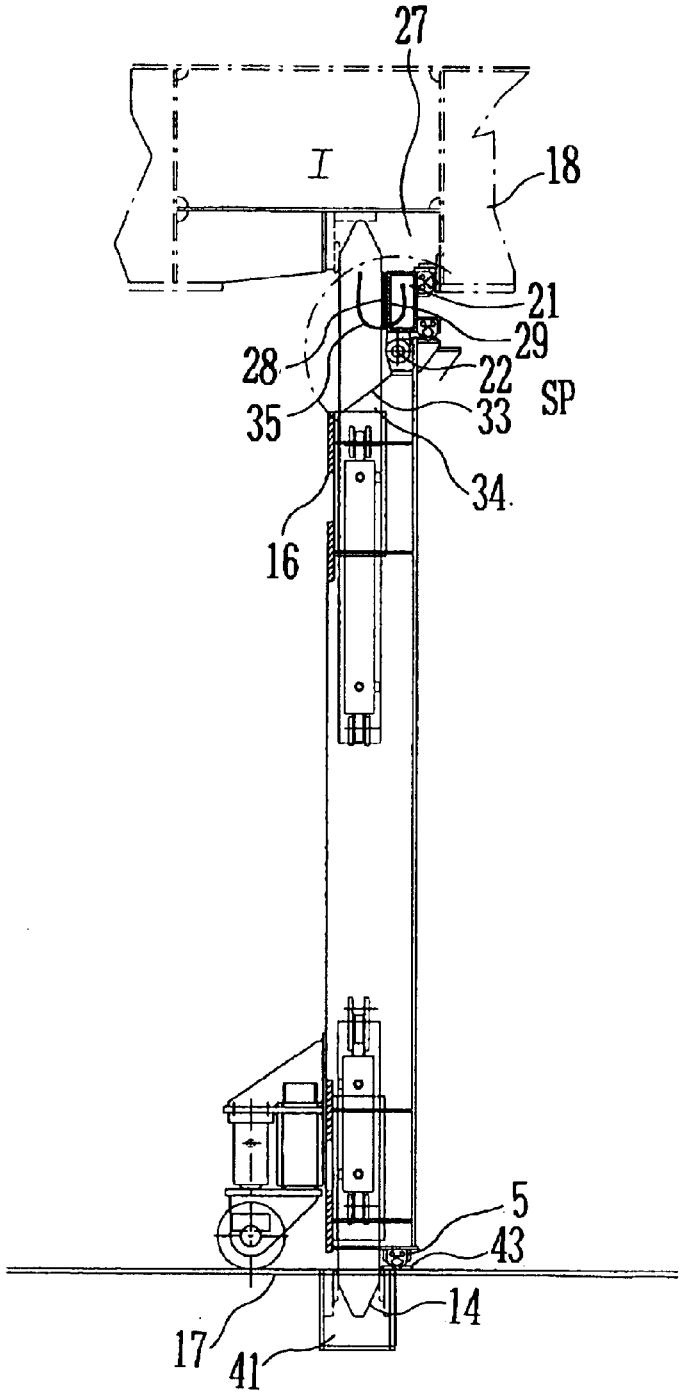
Figure 16:
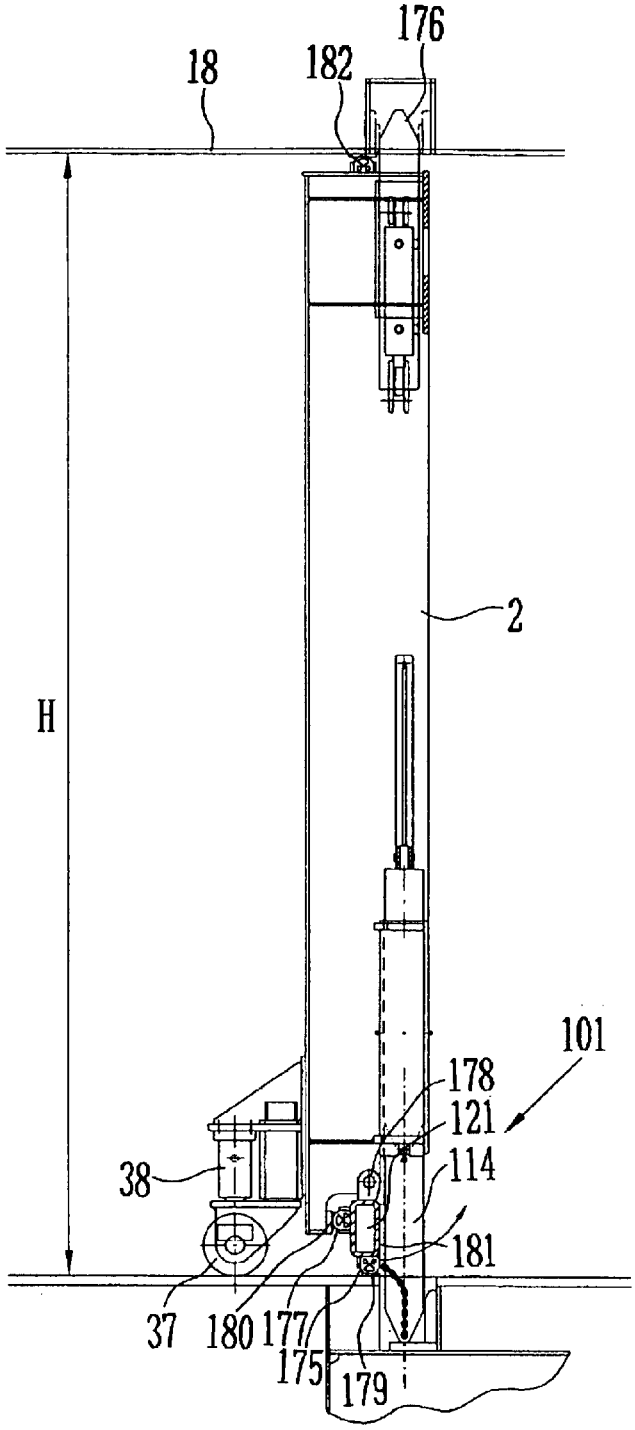
Figure 17:
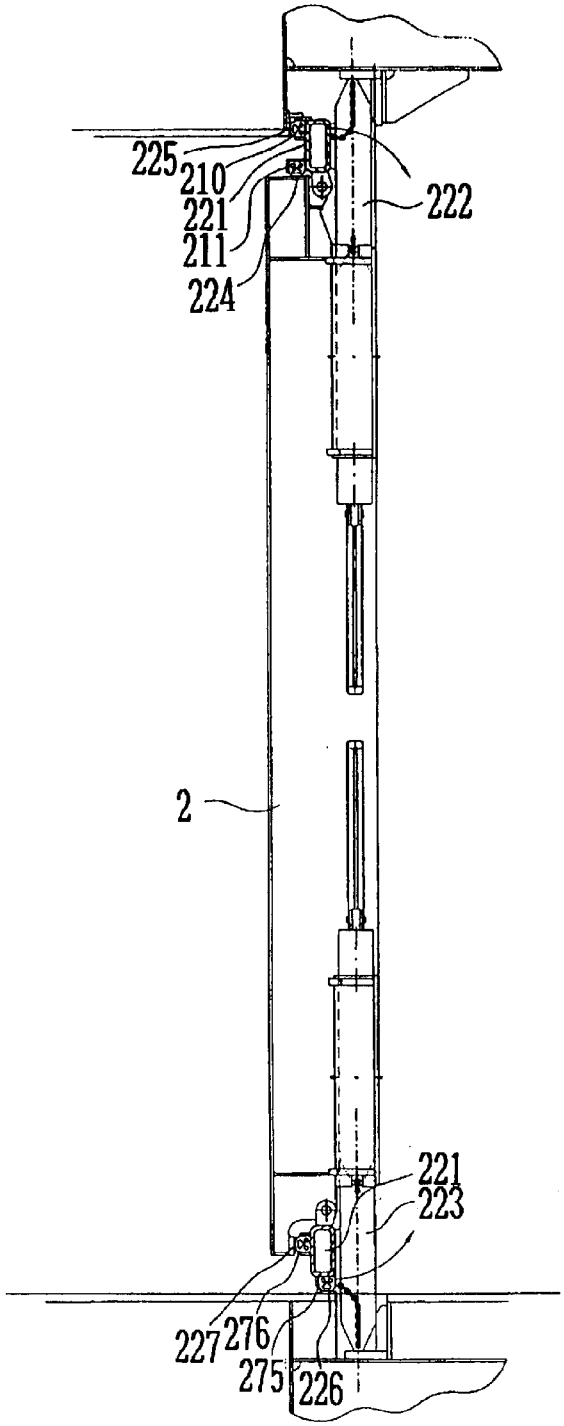

FIG. 15 also shows a sectioned view of the door with its locking and sealing elements in active locking and sealing positions;

FIG. 16 shows a cross-section of an illustrative example with sealing elements situated at the bottom of a door;

FIG. 17 shows a cross-section of a further illustrative example with sealing elements situated both at the bottom and at the top of a door along the horizontal edges of the door.

An arrangement 1 for a pivotally mounted door 2, of the kind which is pivotally mounted preferably at 180° but at least at 90° between the open position OP and the closing position CP, is so arranged as to be capable of closing off a load area 3 on board a ship 4.

The aforementioned door 2 is provided with appropriate sealing elements 5–13, for example made of rubber or plastic, which extend along the periphery of the door. The door arrangement also exhibits battening jacks 14–16 which are arranged for battening the door to the deck 17, 18 and bulkhead 19 of the ship or fixed locking components, e.g. rails, rigidly attached thereto.

In accordance with the present invention, a pivotally mounted sealing element 10–13 is present along the top edge 20 of the door. The aforementioned sealing element 10–13 is supported essentially by a horizontal rigid rail 21, which is supported in a pivotally mounted fashion via a pivoting articulation 22 on the top edge 20 of the door. The aforementioned upper moving sealing elements 10–13 are so arranged as to be actuated by a number of the aforementioned battening jacks 16 and to be caused to move into a sealing position SP along the aforementioned top edge 20 of the door into contact respectively with an upper and lower contact surface 23, 24 functioning as a sealing face.

The aforementioned sealing supporting rail 21 supports an upper sealing element 10 of the intended kind sealing against the upper deck 18 of the ship or parts thereof extending along the upper pivoting end part 25 of the sealing supporting rail 21. The aforementioned sealing supporting rail 21 also supports a lower sealing element 11, which is capable of being brought into contact so as to effect a seal against a sealing face 24 on the upper part of the door 2 and supported by the door 2, which sealing element is so arranged as to seal the space 26 formed between the sealing supporting rail 21 and the top edge 20 of the door.

Figure 1:
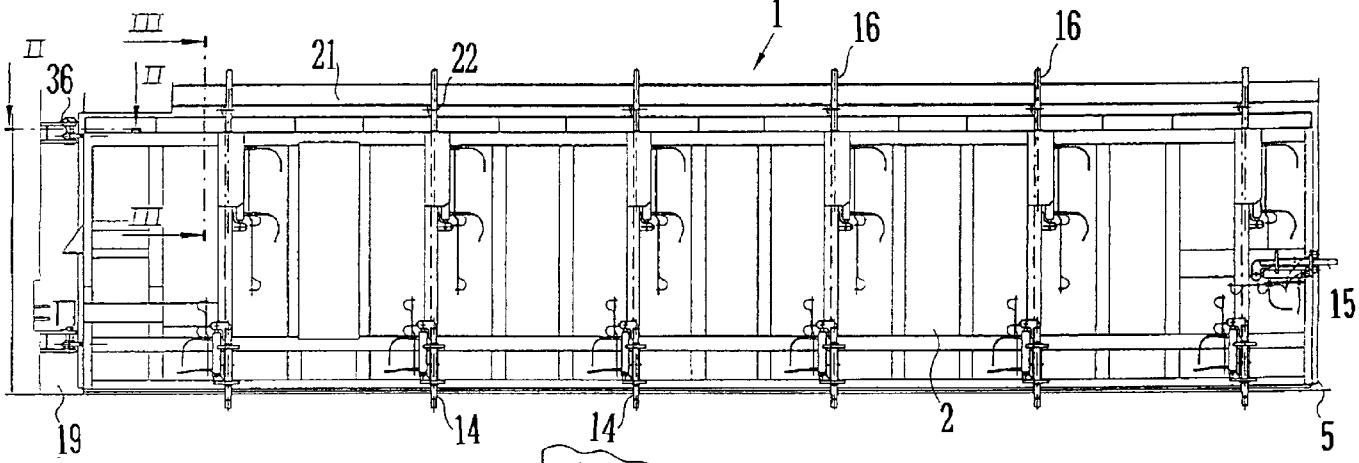
Figure 3:
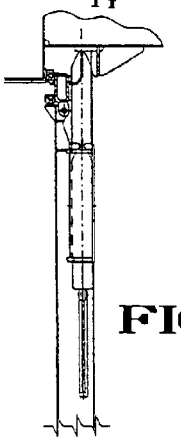
FIG. 3 shows a sectioned view of the door along line III—III in FIG. 1.
Figure 2:
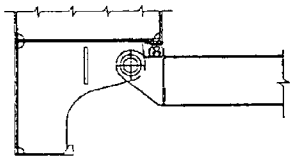
FIG. 2 shows a part of the pivot bearing of the door viewed along line II—II in FIG. 1.
Figure 4:
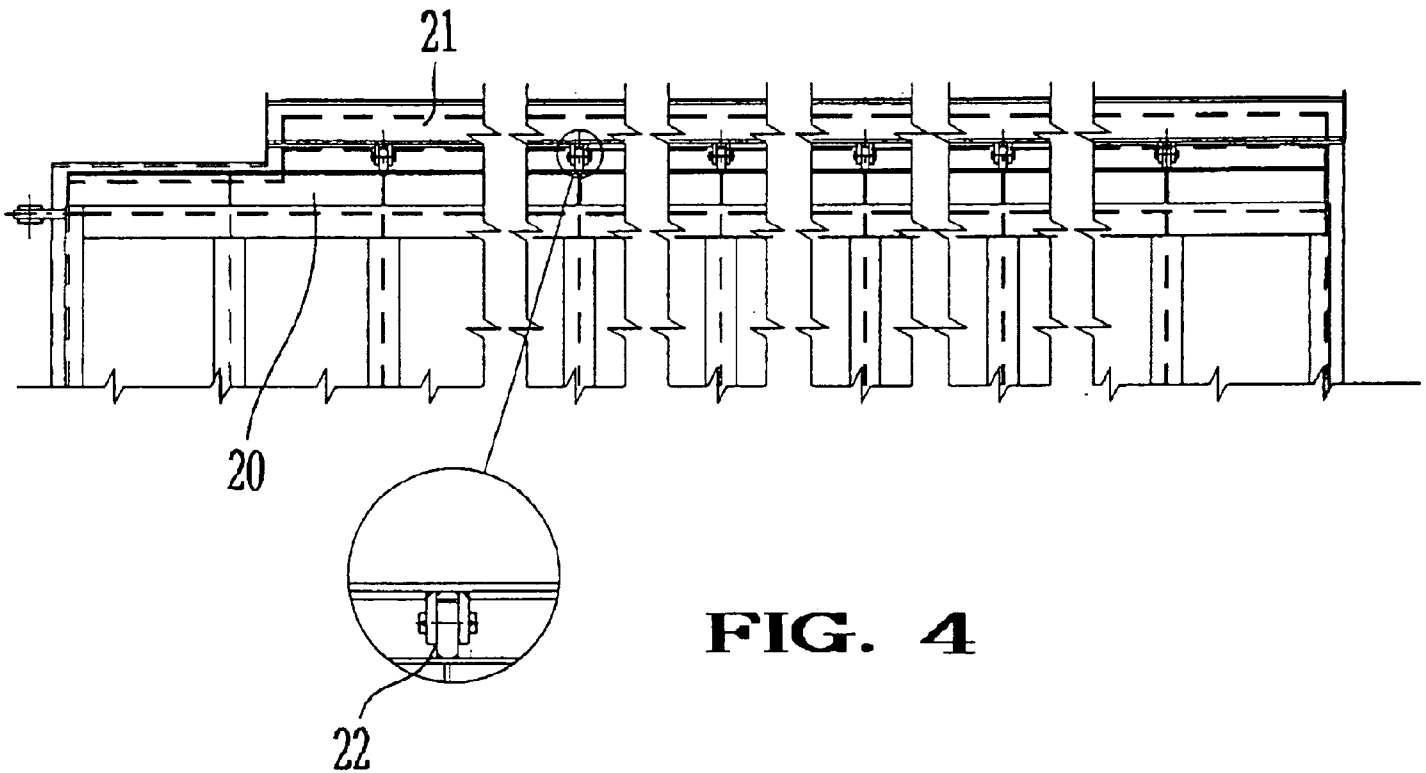
FIG. 4 shows a hinged articulation arrangement for the moving sealing part.
Figure 6:
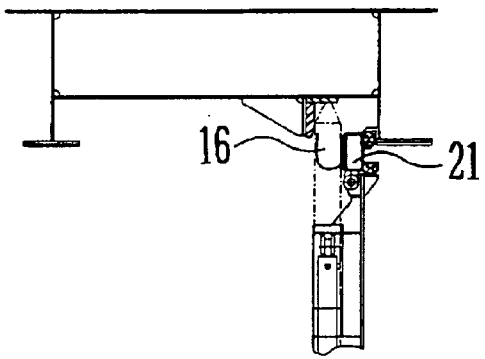
FIG. 6 shows the seals and their actuating jack.
Figure 5:
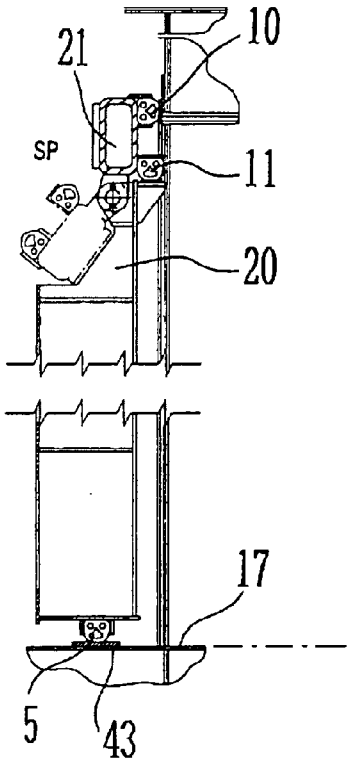
FIG. 5 shows a sectioned view of the door with the seals in an active sealing position.
Figure 7:
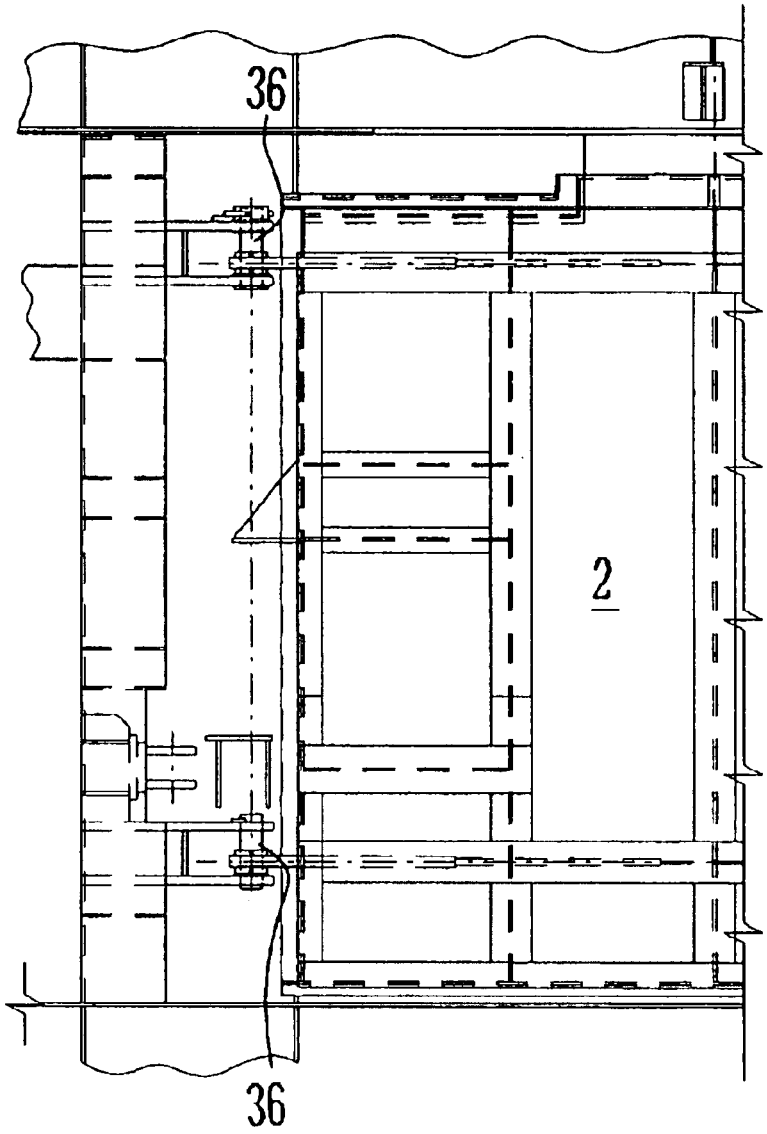
FIG. 7 shows the inner part of the door with the associated pivot bearing and a sealing arrangement.
Figure 8:
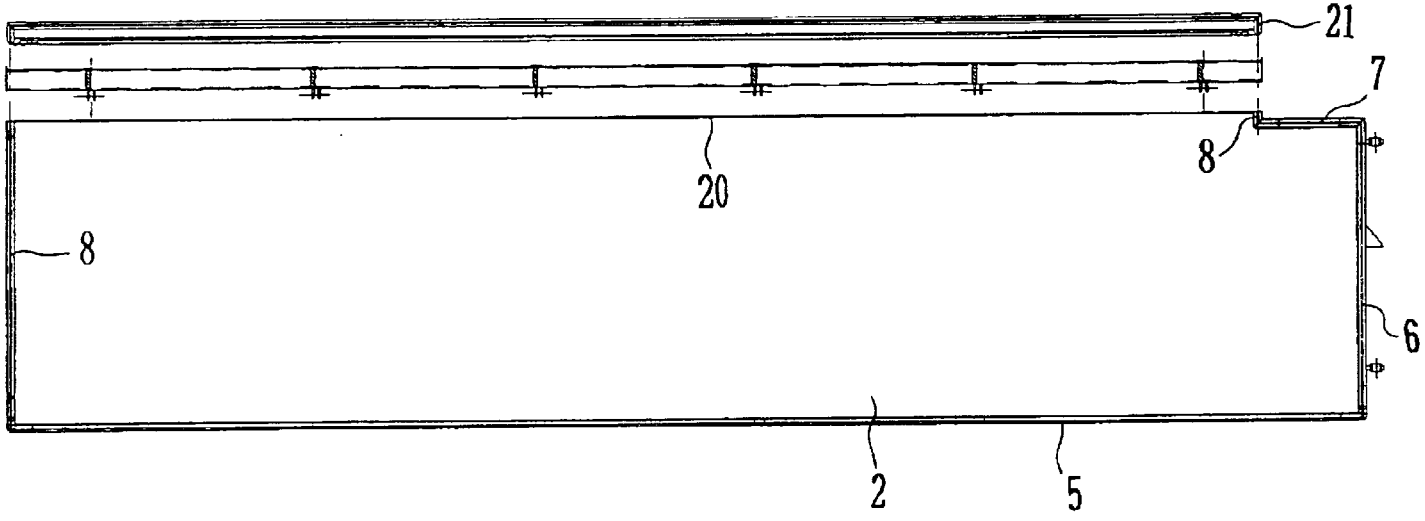
FIG. 8 shows a further side view of the door and a sealing arrangement along the peripheral edges of the door.
Figure 10:
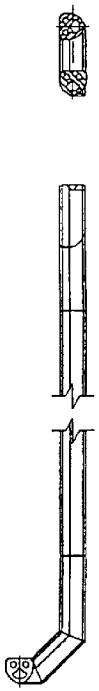
FIG. 10 shows a sectioned view along line X—X in FIG. 9.
Figure 9:
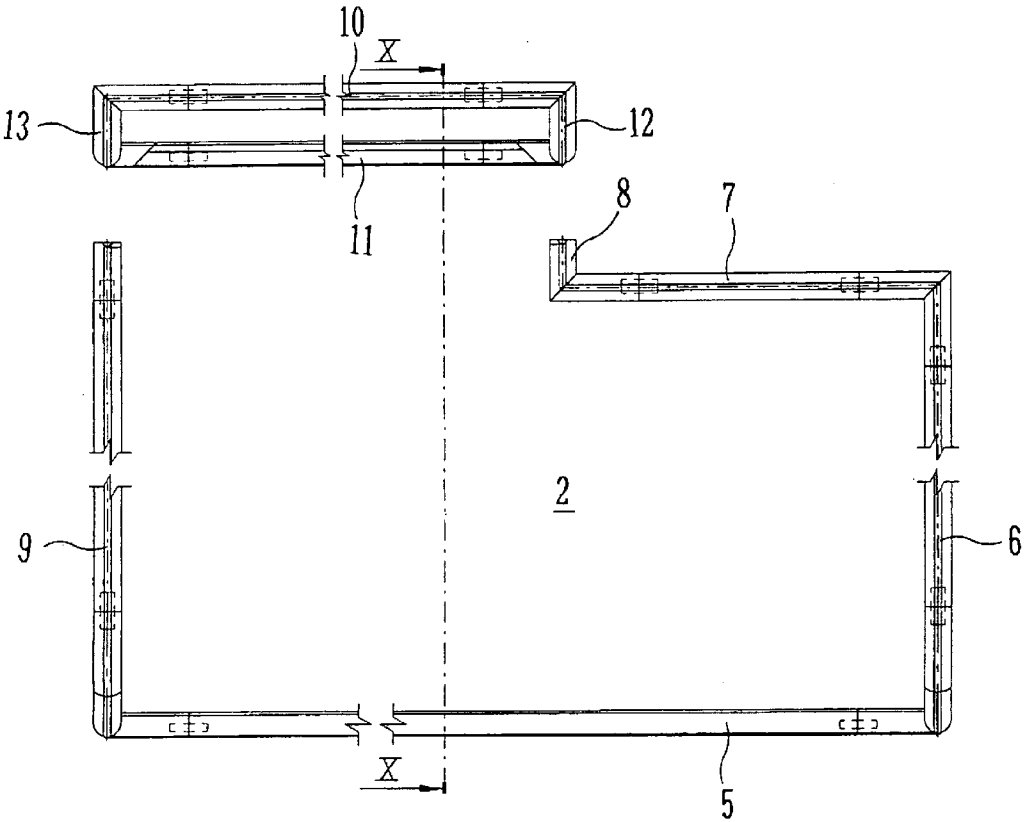
FIG. 9 shows the extent of the sealing arrangements in a door.
Figure 12:
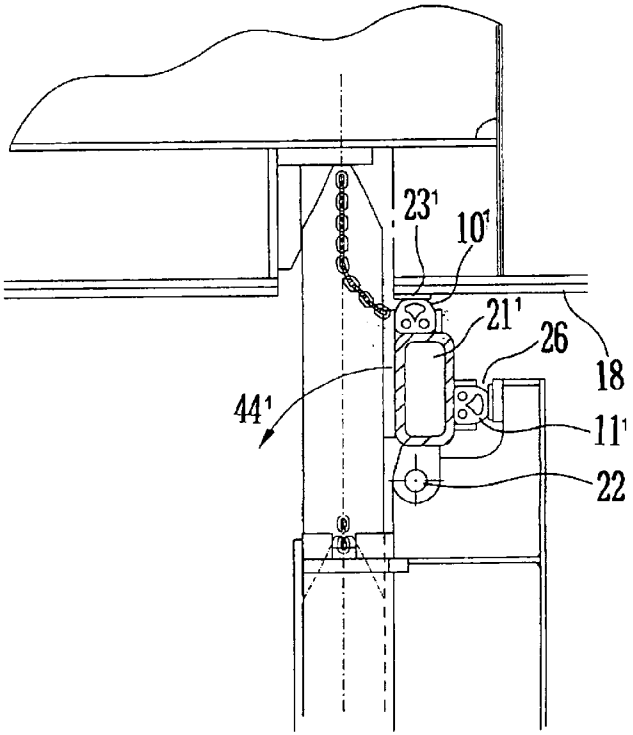
FIG. 12 shows a section along a second illustrative example of a seal in contact with the deck and the door.

An alternative embodiment of the arrangement of the sealing elements $\mathbf{10}^1$, $\mathbf{11}^1$ is shown in FIG. 12 and is so arranged in this case, instead of making contact at the top with a vertical contact surface 23 in a recess or a projection 27 in the upper deck 18 of the ship, as to make contact with a contact surface $\mathbf{23}^1$ in the smooth horizontal upper deck 18.

The sealing element $\mathbf{11}^1$ is so arranged at the bottom next to the aforementioned sealing supporting rail $\mathbf{21}^1$ as to make contact with a vertical upper flange $\mathbf{24}^1$ in the door 2. With the aforementioned arrangement, the need to arrange weakened recesses or other projections in the deck 18 is avoided.

In this way the contact surface, with which the moving upper seal 10 comes into contact, is formed from an essentially horizontal part $\mathbf{23}^1$ of an upper deck 18, as shown in FIG. 12, for example, or from a vertical part 23 of a recess or a projection 27 in the upper deck 18.

Figure 11:
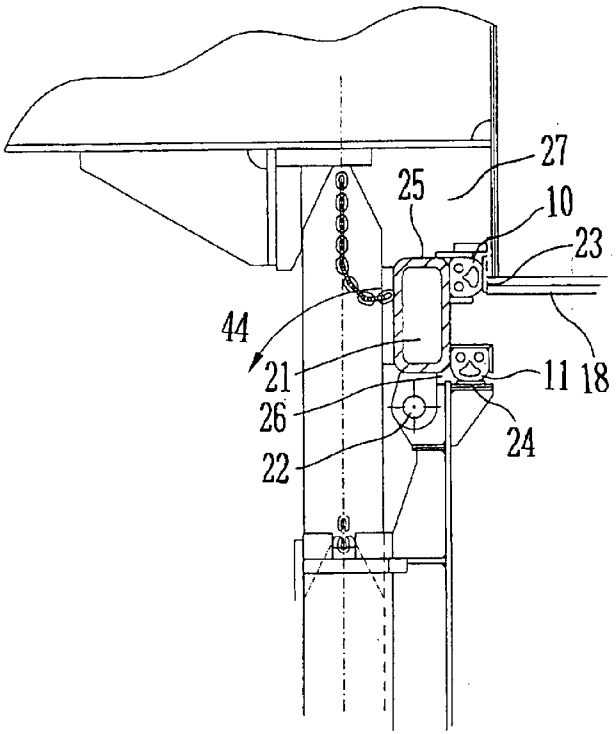
FIG. 11 shows a section along a first illustrative example of a seal in contact with the deck and the door.
Figure 13:
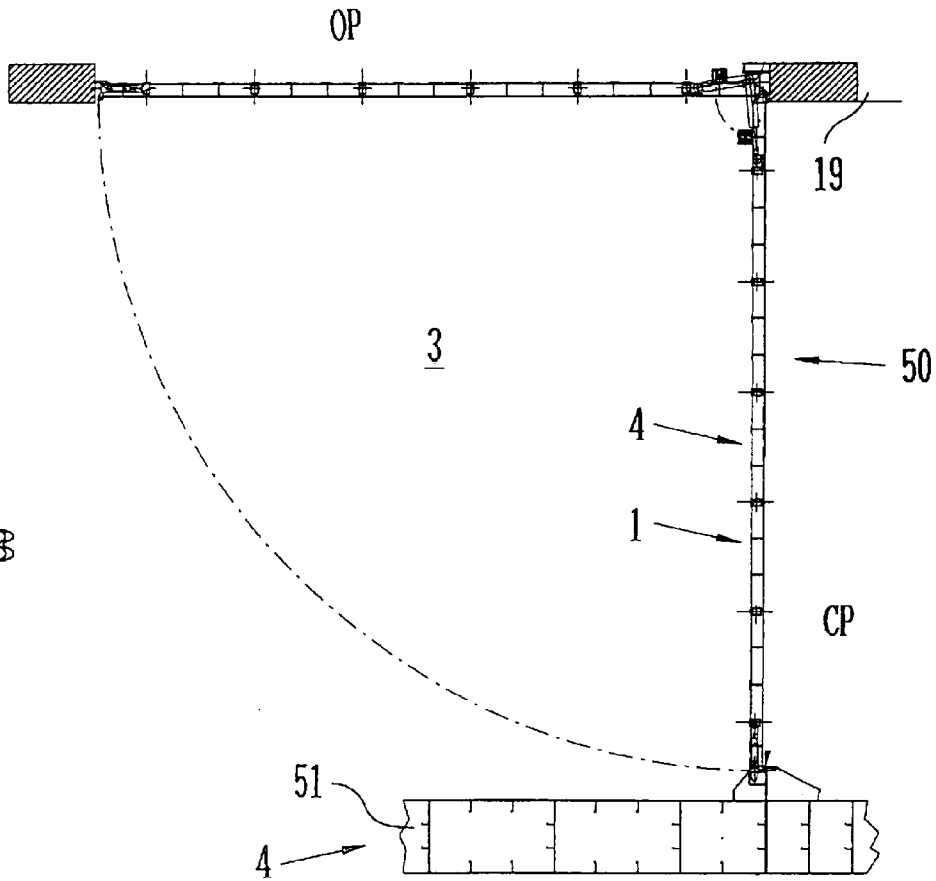
FIG. 13 shows a top view of the different pivot positions of a door.

The moving sealing element 11[1], 11, which is so arranged as to seal between the upper edge 20 of the door 2 and the aforementioned sealing rail 21, is so arranged as to seal against a stop 24[1], 24, which is so arranged as to extend essentially vertically or essentially horizontally supported by the door 2; see FIG. 12 and FIG. 11 respectively.

One side 28 of an aforementioned battening jack 16, which is preferably executed with square cross-section, is so arranged by making contact with one side 29 of the sealing supporting rail 21, as to interact with the same in order to cause the aforementioned sealing supporting rail 21 to pivot in an upward direction 30. However, the front part 31 of the aforementioned battening jack 16 is so arranged as initially to lift up the sealing supporting rail 21 at the time of initiating its upward-pivoting phase.

The aforementioned battening jack 16 appropriately consists of a number of preferably hydraulically powered piston cylinders distributed along the longitudinal extent of the door, which are accommodated in matching spaces 32 in the inside of the door. In the extended position I, each piston rod 33 is so arranged as to be accommodated in, for example, a matching recess 27 provided for this purpose in the upper deck 18 in the hull of the ship.

In order to enable the moving, pivoting sealing arrangement 10–13 to be brought down from the sealing I upward-pivoted position SP to a downward-pivoted II non-sealing opening position OP, in which position the sealing supporting rail 21 is in contact with an upper inclined part 34 of the door 2, a drawing device 35 is so arranged as to connect the sealing supporting rail 21 with an aforementioned battening jack piston rod 33.

The aforementioned drawing device preferably consists of a chain 35, a cable, a rope or some other flexible device.

Figure 14:
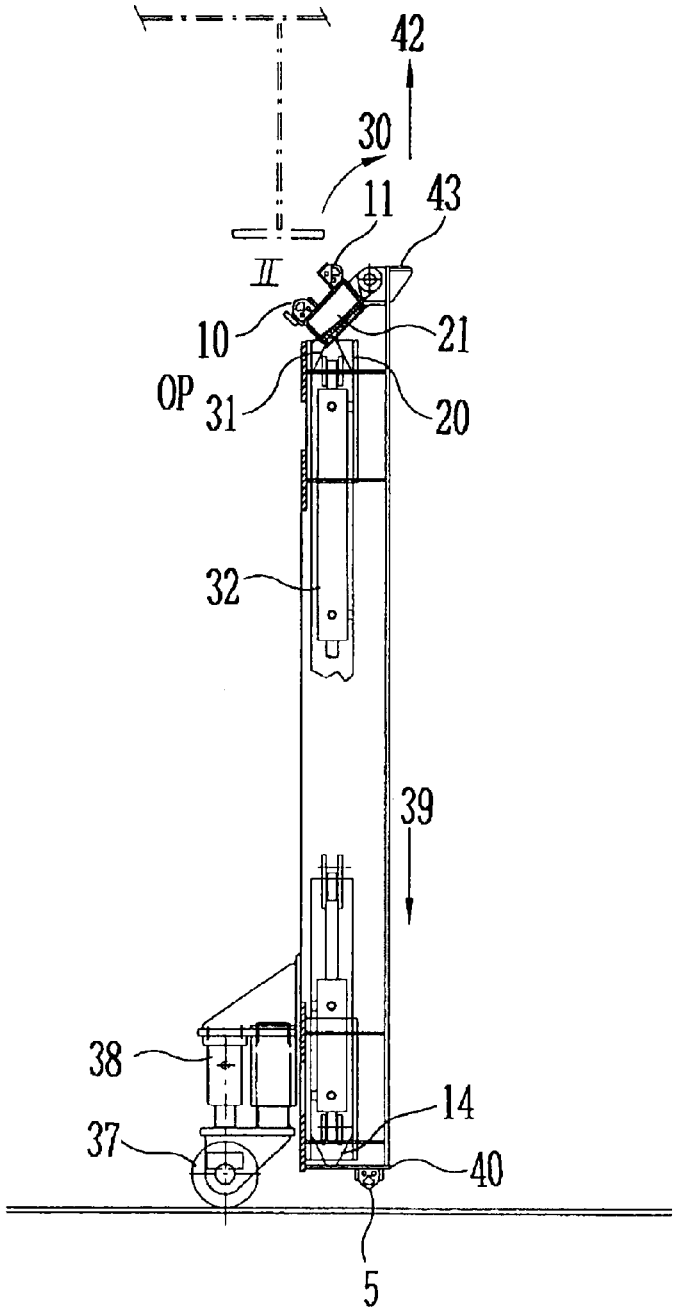
FIG. 14 shows a sectioned view of the door and its locking and sealing elements in non-active positions.

The function of the invention should have emerged from the above description and the illustrations in the drawings, although the function is clearly illustrated in the drawings in FIGS. 14 and 15. When the door 2 has been swung outwards from its open position OP closely along a bulkhead 19, for example in the central part of the ship, about the pivoting articulations 36 of the door, and has rolled on the deck 17 with the help of telescopically moving support wheels 37, a piston cylinder 38 on the bottom part of the door is activated so that the door 2 is lowered in the direction of the arrow 39. The seal 5, which is situated on the bottom part of the door and extends along the lower edge 40 of the door, then comes into sealing contact with the deck 17; see FIG. 15. The preferably hydraulically powered piston cylinders 14, 15, 16 are then actuated so that they are each accommodated in their own recess 41, 27 in the deck or in a bulkhead. When the upper jacks 16 are extended in a direction upwards 42, the sealing supporting rail 21 is caused to pivot upwards at the same time in the direction of the arrow 30 so that the moving seals 10, 11 each come into sealing contact with their own sealing contact surface 23, 24; 23[1], 24[1]. In conjunction with this, the aforementioned seals can make contact with an evenly adjustable sealing surface, for example welded-on strips 43 of metal.

The seals in this case seal effectively around the periphery of the entire door, so that a watertight door 2 is able to close off the opening 50 capable of being closed off by the door 2 between the bulkhead 19, 51 in the space 3 inside the ship that it is wished to seal, for example a space accessible by vehicles in a ferry that it is wished to make secure if water were to find its way into the ship. When the battening jacks 16 are subsequently caused to retract and thus to withdraw from their accommodating openings or projections 27 in the ship, the sealing supporting rail 21 falls down in the direction of the arrow 44 or 44[1], and in conjunction with this the moving seals leave their sealing positions. The door 2 can then be raised and caused to pivot to its open position.

The illustrative embodiment of a sealing arrangement 101 shown in FIG. 16 exhibits a fixed upper seal 176, which comes into contact with the upper deck 18 when the wheel 37 and the wheel jack 38 of the door are activated and have forced the door upwards. The existing door battening jacks 176, 114 are then actuated, of which the lower ones cause the lower seals 175, 177 to be made to pivot about a common pivoting articulation 178 and into engagement with the intended contact surface 179, 180. The aforementioned lower seals are also supported by a pivotally mounted rigid transverse rail 181.

The seal at the bottom is thus effectively released, and at the top a fixed seal 182 seals against the upper deck 18, etc. Upward pivoting of the lower sealing rail 181 can preferably take place by means of drawing devices (not shown here), which are connected to the sealing supporting rail 181 and a number of the lower jacks 114, in conjunction with which the upward movement of the jacks is transferred to the aforementioned sealing supporting rail 181.

Finally, illustrated in FIG. 17 is an example of how moving seals 210, 211, 275, 276 capable of actuation can be arranged connected in pairs each to their own rigid sealing supporting rail 221 both at the top and at the bottom of the door 2. In this case, too, the battening jacks 222, 223 take care of causing the sealing supporting rails 221 to pivot to a sealing position, so that the seals supported by them come into contact with a matching contact surface 224–227 after activation of the aforementioned battening jacks 222, 223. No support wheel is required in this embodiment with movable seals both at the top and at the bottom of the door, but the door 2 can be mounted only pivotally at a certain specified distance from the lower deck.

The invention is naturally not restricted to the embodiments described above and illustrated in the drawings. Modifications are possible, especially with regard to he nature of the different parts, or through the use of equivalent technology, without departing from the area of protection afforded to the invention as defined in the Patent Claims.

What is claimed is:

1. Seal for a pivotally mounted door the door arranged to close off a load area on board a ship and is provided with sealing elements around the periphery of the door and exhibits battening jacks that are caused to move to batten down the door to a deck and a bulkhead of the ship, characterized in that the sealing elements are pivotally supported along at least one of a top edge or a bottom edge of the door, the sealing elements are capable of actuation by a number of the battening jacks causing the sealing elements to be moved into a sealing position along the at least one of a top edge or a bottom edge of the door against a contact surface wherein the sealing elements are supported by a horizontal sealing support rail, and a drawing device is so arranged as to connect the sealing support rail with a battening jack piston rod.

2. The seal according to claim 1, characterized in that the sealing elements located on the top edge of the door are supported by the door.

3. The seal according to claim 1, characterized in that the sealing support rail supports an upper sealing element sealing against the deck of the ship extending along an upper pivoting end part of the sealing support rail and a lower sealing element which seals against a sealing face on the upper part of the door, which is so arranged as to seal between the sealing support rail and the top edge of the door.

4. The seal according to claim 3, wherein the sealing element between the upper edge of the door and the sealing support rail is so arranged as to seal against a stop, which is arranged vertically or horizontally and supported by the door.

5. The seal according to claim 3, wherein one side of the at least one of the battening jacks is so arranged, by making contact with the sealing support rail as to interact with the sealing support rail in order to cause the sealing support rail to pivot upwards.

6. The seal according to claim 3, wherein the contact surface is in contact with a moving upper seal and is formed from an essentially horizontal part of the deck or from a vertical part of a recess in the deck.

7. The seal according to claim 6, wherein the sealing element between the upper edge of the door and the sealing rail, is so arranged as to seal against a stop, which is arranged vertically or horizontally and is supported by the door.

8. The seal according claim 3, characterized in that the sealing elements located on the top edge of the door are supported by the door.

9. The seal according to claim 8, wherein one side of at least one of the battening jacks is so arranged, by making contact with the sealing support rail, as to interact with the sealing support rail in order to cause the sealing support rail to pivot upwards.

10. The seal according to claim 9, characterized in that the drawing device consists of a chain, a cable, or a rope.

11. The seal according to claim 10, where in the contact surface is in contact with a moving upper seal and is formed from n essentially horizontal part of the deck or from a vertical part of a recess in the deck; and wherein the sealing element between the upper edge of the door and the sealing support rail, is so arranged as to seal against a stop, which is arranged vertically or horizontally and is supported by the door.

12. The seal according to claim 9, wherein at least one of the battening jacks consists of piston cylinders, each having an extendable piston rod so arranged as to be accommodated in a recess or in a projection provided in the hull of the ship.

13. The seal according to claim 12, wherein the contact surface is in contact with a moving upper seal and is formed from an essentially horizontal part of the deck or a vertical part of a recess in the deck.

14. The seal according to claim 12, characterized in that the drawing device consists of a chain, a cable, or a rope.

15. The seal according to claim 1, characterized in that the drawing device consists of a chain, a cable, or a rope.

16. The seal according to claim 15, wherein one side of at least one of the battening jacks is so arranged, by making contact with the sealing support rail as to interact with the sealing support rail in order to cause the sealing support rail to pivot upwards.

17. The seal according to claim 1, wherein one side of at least one of the battening jacks is so arranged, by making contact with the sealing support rail, as to interact with the sealing support rail in order to cause sealing support rail to pivot upwards.

18. The seal according to claim 1, wherein at least one of the battening jacks consists of piston cylinders, each having an extendable piston rod so arranged as to be accommodated in a recess or in a projection in the hull of the ship.

19. The seal according to claim 1, wherein the contact surface is in contact with a moving upper seal and, is formed from an essentially horizontal part of the deck or from a vertical part of a recess in a the deck.

20. The seal according to claim 19, wherein the sealing element between the upper edge of the door and the sealing support rail is so arranged as to seal against a stop which is arranged vertically or horizontally and is supported by the door.

* * * * *